US009573707B2

(12) United States Patent
Owczarek et al.

(10) Patent No.: US 9,573,707 B2
(45) Date of Patent: Feb. 21, 2017

(54) FILLING HOPPER FOR A FILLING APPARATUS FOR MULTI-SEGMENT TRAYS

(75) Inventors: Radoslaw Owczarek, Radom (PL); Marek Warchol, Radom (PL); Leszek Sikora, Radom (PL)

(73) Assignee: INTERNATIONAL TOBACCO MACHINERY POLAND SP. Z O. O., Radom (PL)

( * ) Notice: Subject to any disclaimer, the term of this patent is extended or adjusted under 35 U.S.C. 154(b) by 433 days.

(21) Appl. No.: 14/232,599

(22) PCT Filed: Aug. 17, 2012

(86) PCT No.: PCT/PL2012/050029

§ 371 (c)(1),
(2), (4) Date: Jan. 16, 2014

(87) PCT Pub. No.: WO2013/025114

PCT Pub. Date: Feb. 21, 2013

(65) Prior Publication Data

US 2014/0158252 A1 Jun. 12, 2014

(30) Foreign Application Priority Data

Aug. 18, 2011 (PL) ..... 395997

(51) Int. Cl.
*A24C 5/33* (2006.01)
*B65B 5/06* (2006.01)
*A24C 5/354* (2006.01)

(52) U.S. Cl.
CPC ..... *B65B 5/068* (2013.01); *A24C 5/354* (2013.01)

(58) Field of Classification Search
CPC ..... A24C 5/354; B65B 5/068
(Continued)

(56) References Cited

U.S. PATENT DOCUMENTS 3,241,289 A 3/1966 Molins
4,691,848 A 9/1987 Gianese
(Continued)

FOREIGN PATENT DOCUMENTS

CN 87107415 A 8/1988
CN 101254831 A 9/2008
(Continued)

OTHER PUBLICATIONS

International Search Report from PCT/PL2012/050029 mailed Mar. 25, 2013.
(Continued)

*Primary Examiner* — Michael H Wilson
*Assistant Examiner* — Yana B Krinker
(74) *Attorney, Agent, or Firm* — Oppedahl Patent Law Firm LLC

(57) ABSTRACT

The object of the application is a filling hopper for a filling apparatus for multi-segment trays in the tobacco industry with a receiving region for rod like articles in the form of a mass flow and a storing region for rod like articles comprising side walls (8, 9) and a bottom wall (10), whereas the storing region has double partition walls (16) alternately forming a plurality of parallel cavities (15) and slots (14), where the partition walls (16) extend in principle along the entire height of the storing region. The partition walls (16) are connected with each other by means of a carrying framework so that at least from one side free access to the articles inside the cavities (15) is maintained. The carrying framework comprises at least one fastening area (19).

4 Claims, 8 Drawing Sheets

(58) Field of Classification Search
USPC ..... 131/282
See application file for complete search history.

(56) References Cited

U.S. PATENT DOCUMENTS

| | | | | |
|---|---|---|---|---|
| 4,827,691 | A | 5/1989 | Hanada | |
| 7,757,465 | B2 | 7/2010 | Budny et al. | |
| 8,100,621 | B2 | 1/2012 | Budny et al. | |
| 8,662,088 | B2 | 3/2014 | Owczarek | |
| 8,869,969 | B2 | 10/2014 | Cie likowski et al. | |
| 8,925,708 | B2 | 1/2015 | Cie likowski et al. | |
| 8,967,370 | B2 | 3/2015 | Cie likowski et al. | |
| 9,004,261 | B2 | 4/2015 | Cie likowski et al. | |
| 9,061,835 | B2 | 6/2015 | Cie likowski et al. | |
| 9,161,571 | B2 | 10/2015 | Sikora | |
| 2008/0190074 | A1* | 8/2008 | Budny | A24C 5/354 53/473 |
| 2008/0213072 | A1 | 9/2008 | Budny et al. | |
| 2008/0223803 | A1 | 9/2008 | Budny et al. | |
| 2013/0087056 | A1 | 4/2013 | Chojnacki | |
| 2014/0011652 | A1 | 1/2014 | Cieslikowski et al. | |
| 2014/0097107 | A1 | 4/2014 | Zagajska | |
| 2014/0123826 | A1 | 5/2014 | Cieslikowski et al. | |
| 2014/0235416 | A1 | 8/2014 | Lisowski et al. | |
| 2015/0013519 | A1 | 1/2015 | Cieslikowski et al. | |
| 2015/0047137 | A1 | 2/2015 | Gielniewski | |
| 2015/0068376 | A1 | 3/2015 | Boleslawski | |
| 2015/0114543 | A1 | 4/2015 | Riedel | |
| 2015/0114988 | A1 | 4/2015 | Riedel | |
| 2015/0342247 | A1 | 12/2015 | Ugrewicz | |
| 2016/0000142 | A1 | 1/2016 | Stanikowski et al. | |

FOREIGN PATENT DOCUMENTS

| | | | |
|---|---|---|---|
| CN | 101677627 | A | 3/2010 |
| CN | 101677626 | A | 3/2013 |
| EP | 1277415 | A1 | 1/2003 |
| EP | 1952705 | A2 | 8/2008 |
| EP | 1955604 | A1 | 8/2008 |
| EP | 1972212 | A1 | 9/2008 |
| JP | 2008195458 | A | 8/2008 |

OTHER PUBLICATIONS

Written Opinion of the International Searching Authorities from PCT/PL2012/050029 mailed Mar. 25, 2013.
Search Report for CN103732086.

* cited by examiner

FILLING HOPPER FOR A FILLING APPARATUS FOR MULTI-SEGMENT TRAYS

The object of the application is a filling hopper for a filling apparatus for multi-segment trays in the tobacco industry.

In the tobacco industry, filling apparatuses for multi-segment trays are used in which filter rods, cigarettes, cigarillos or other tobacco industry products, hereinafter referred to as rod like articles, are temporarily stored, for example in storages or for the transport between the manufacturing machines. Such articles are most frequently conveyed between the machines in the form of a mass flow where the articles are arranged principally parallel to each other, perpendicular to the direction of movement of the flow. However, it happens that in the mass flow of rod like articles incorrectly arranged articles or fragments thereof move, most frequently on the side invisible to the operator, along rear stationary plates guiding the flow and for that reason are not removed from the flow. Such incorrectly arranged articles, in the course of filling in the filling apparatus of the tray, are fed thereinto from the side of the rear wall and remain there until the moment when the tray is emptied. Hereinafter the filling apparatus for multi-segment trays will be also referred to as a multi-segment tray filler or a tray filler.

The problem to be solved by this invention is to develop a filling hopper for the tray filler which ensures that incorrectly arranged articles or fragments thereof moving together with the mass flow supplied to the tray filler are not fed into the tray.

The object of the invention is a filling hopper for a filling apparatus for multi-segment trays in the tobacco industry comprising a receiving region for rod like articles in the form of a mass flow and a storing region for rod like articles which comprises side walls and a bottom wall. The storing region has double partition walls alternately forming a plurality of parallel cavities and slots, where the partition walls principally extend along the entire height of the storing region.

The partition walls are connected with each other by means of a carrying framework so that at least from one side free access to the articles inside the cavities is maintained.

Preferably a filling hopper according to the invention is characterised in that the partition walls are connected with each other by means of a carrying framework so that from both sides free access to the articles inside the cavities is obtained.

Preferably a filling hopper according to the invention is characterized by additionally comprising a front wall, where the partition walls are connected with each other by means of a carrying framework so that free access from behind to the articles inside the cavities is obtained.

Preferably a filling hopper according to the invention is characterised in that the width of the partition walls is smaller than the depth of the storing region.

Preferably a filling hopper according to the invention is characterised in that the carrying framework comprises at least one fastening area, preferably two or three fastening areas.

Preferably a filing hopper according to the invention is characterised in that the bottom wall is a filling unit.

The proposed solution ensures that incorrectly arranged rod like articles situated at the back of the mass flow, after passing through the receiving region of the filling hopper are not held on the side of the rear wall of the tray being filled, are detached from correctly arranged articles and fall outside the tray. Through the framework shape of the filling hopper according to the invention the observation of the process of movement of the articles in the cavities of the storing region from behind of the machine is possible, which in the known tray fillers was heretofore impossible. In addition, the walls of the tray after feeding it in the filling position will be visible from the front of the machine, which was either heretofore impossible.

The object of the invention has been shown in a preferred embodiment in a drawing in which.

Figure 1:
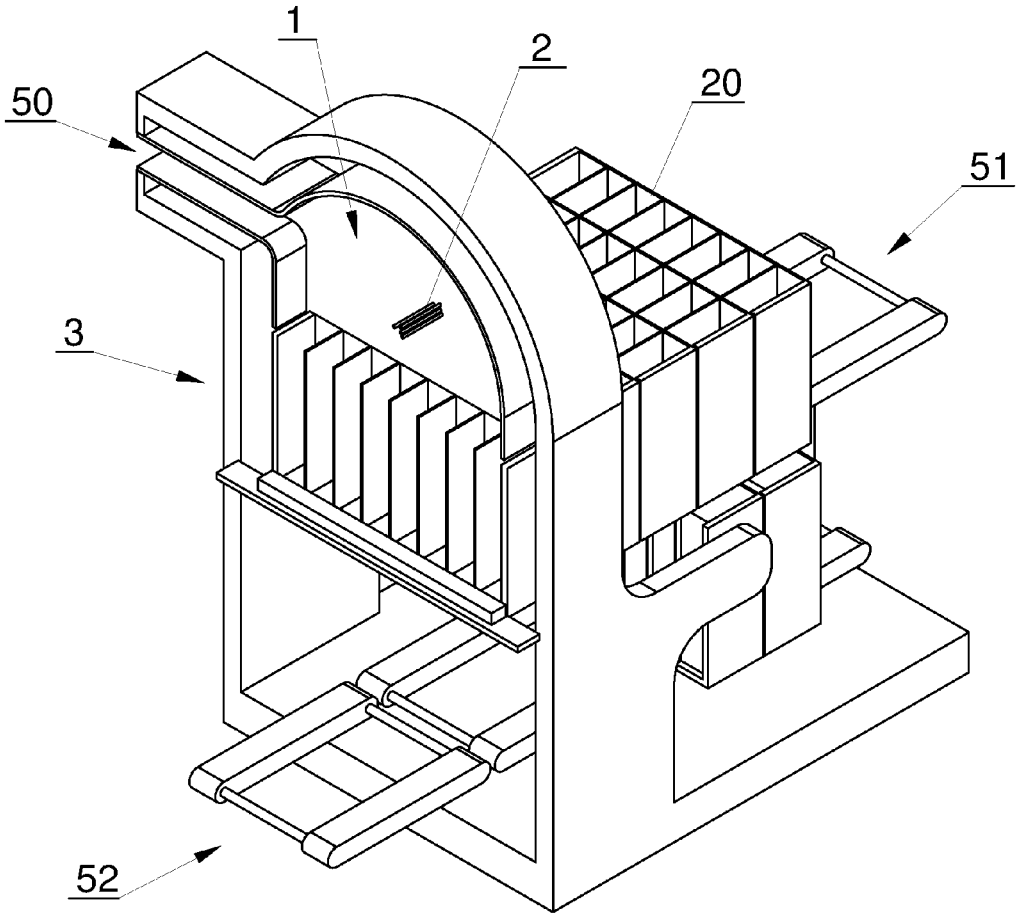
FIG. 1 shows a filling apparatus for multi-segment trays with rod like articles, with a hopper according to the invention.

FIG. 1 shows a filling apparatus for multi-segment trays with rod like articles provided with a filling hopper comprising a receiving region 1 for articles 2 in the form of a mass flow 50 and a storing region 3 from which the articles are fed to trays 20. The trays 20 are fed to the filling hopper along a conveyor for empty trays 51 disposed on the rear side of the apparatus, whereas full trays are conveyed along a conveyor for full trays 52, whereas full trays can be collected from the front or from behind of the apparatus.

Figure 2:
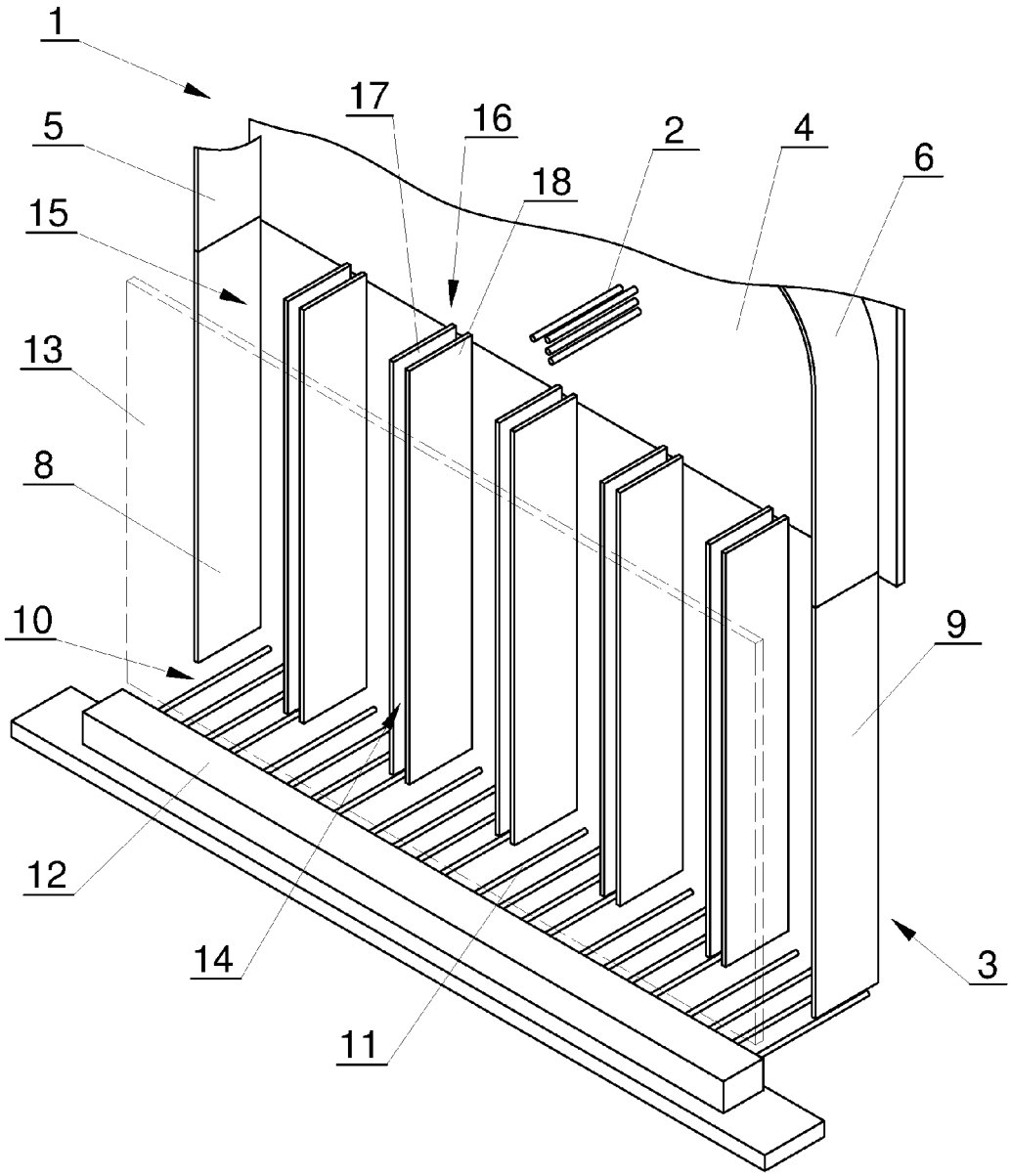
FIG. 2 shows in simplified view a fragment of the front part of a filling hopper of a tray filler according to the invention.

FIG. 2 shows in simplified view a fragment of the front part of a filling hopper of a tray filler, namely the bottom part of a receiving region 1 for rod like articles 2 and a storing region 3 to which the rod like articles are conveyed from the receiving region 1. The rod like articles 2 are stored in the storing region 3 in the form of multiple columns. The receiving region 1 is limited by a rear plate 4, a not shown front plate and side walls 5 and 6 which can take different shapes, for example can be rectilinear or arched. The receiving region 1 is joined with its bottom part with the storing region 3. The storing region 3 is limited by side walls 8 and 9 and a bottom wall 10 formed by working elements 11 of a filling unit 12, optionally it can be also limited by a front wall 13 marked with a broken line, for example in the form of a door. The region 3 is divided into a plurality of cavities 15, whereas the cavities 15 are separated from each other by double partition walls 16 comprising single plates 17 and 18 forming slots 14. The partition walls 16 extend in principle along the entire height of the storing region 3 and can be fastened to the bottom edge of the rear plate 4 limiting the receiving region 1. It should be noted that the storing region does not have a rear wall. The operator is provided with access to the articles in the cavities 15 both from behind and from the front of the filling hopper if the storing region 3 is not provided with a front wall 13, or only from behind if the storing region 3 is provided with a front wall 13. The width of the partition walls 16 is smaller than the depth of the storing region 3 defined as the distance between the bottom edge of the plate 4 and the front wall 13.

Figure 3:
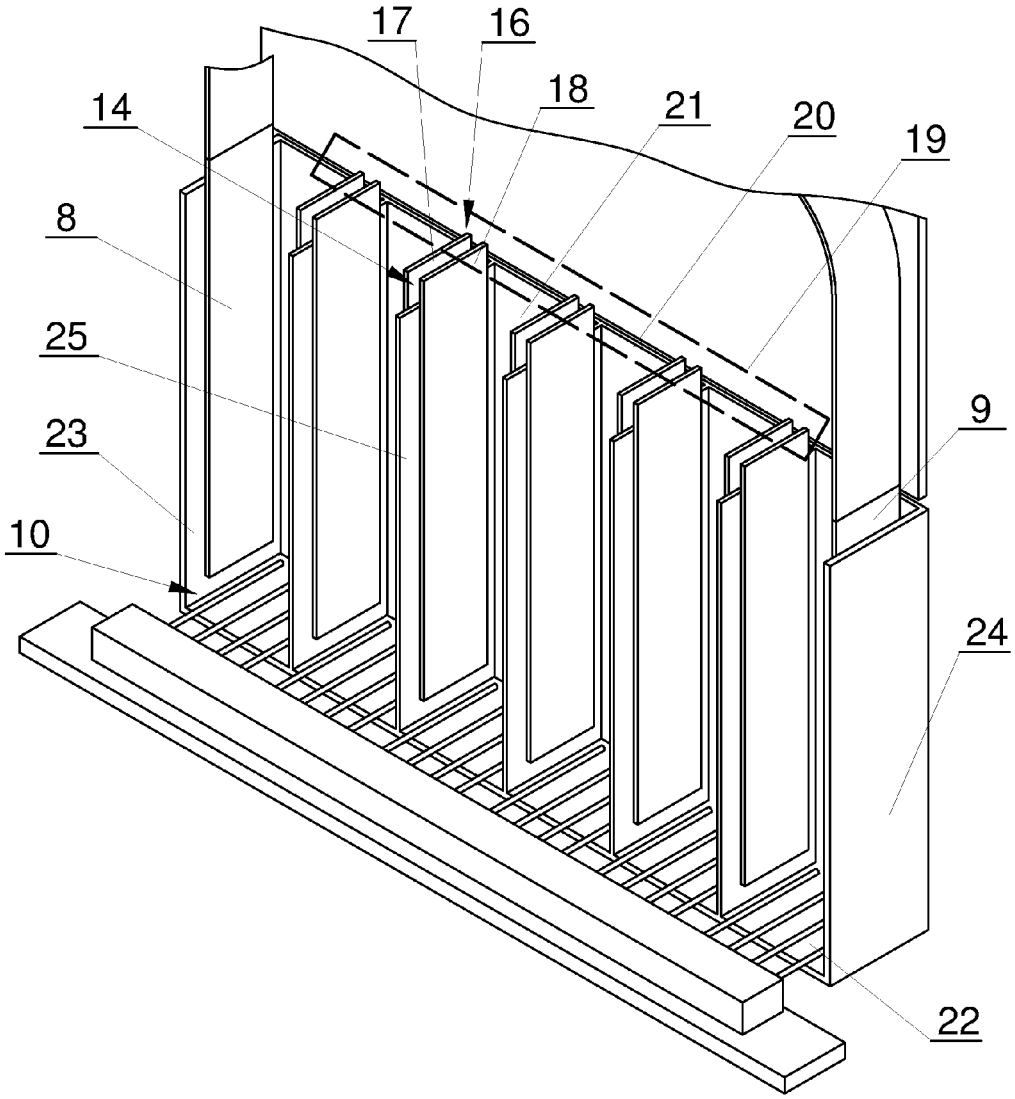
FIG. 3 shows in simplified view a filling hopper together with a tray situated in the filling position.

FIG. 3 shows in simplified view a filling hopper together with a tray 20, disposed in the filling position, provided with a rear wall 21, a bottom wall 22, side walls 23 and 24 and a plurality of partition walls 25. In the filling position the side walls 23 and 24 comprise walls 8 and 9 limiting a storing region 3, the bottom wall 22 is situated below a wall 10, the rear wall 21 of the tray is situated below a wall 4, whereas the partition walls 25 of the tray are inserted inside the partition walls 16, into slots 14 between plates 17 and 18. The plates 17 and 18 are fastened to the wall 4 in the fastening area 19.

Figure 4:
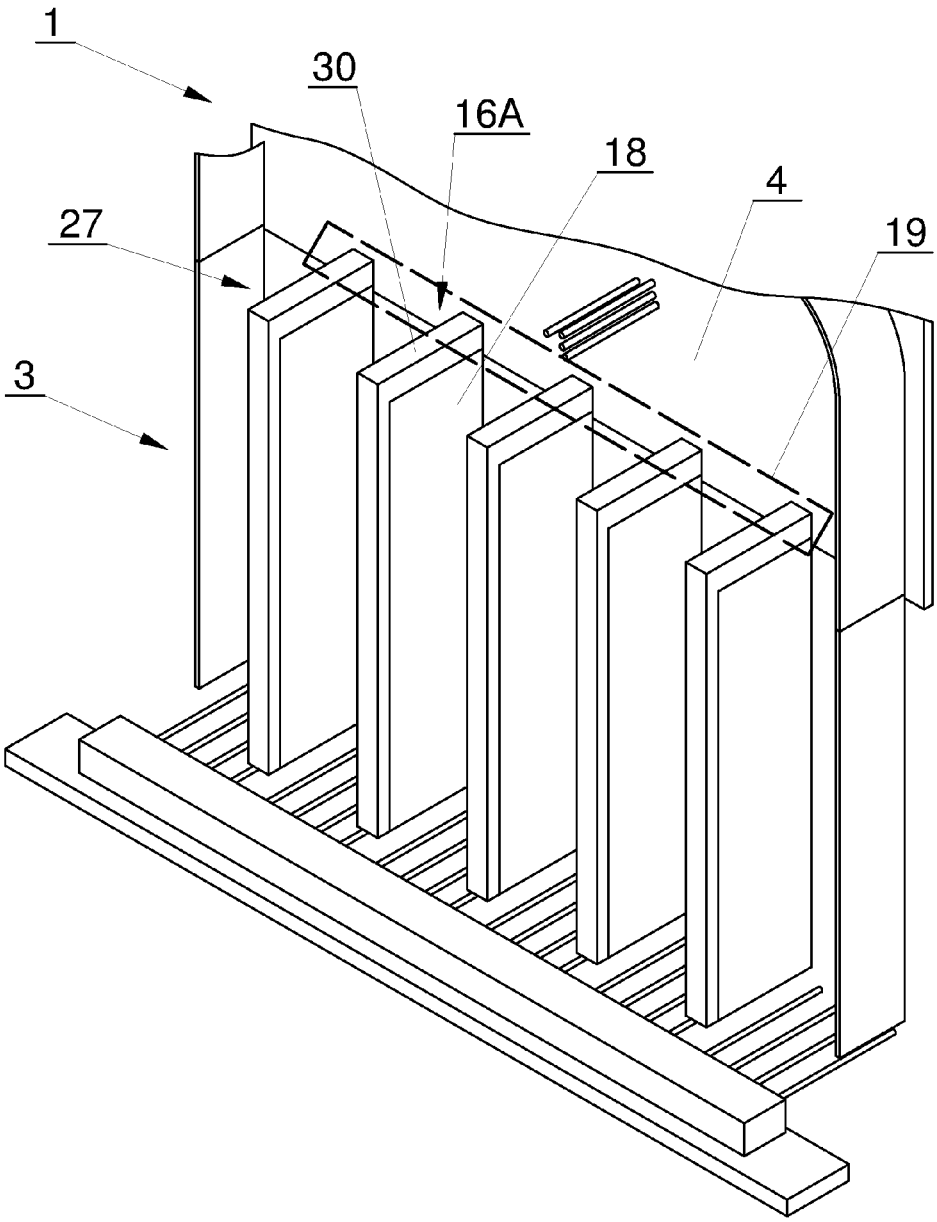
FIG. 4 shows a filling hopper according to the invention in another embodiment.

FIG. 4 shows a filling hopper in which the partition walls 16A are provided with angle brackets 30 fastened to a plate 4, where the said brackets connect the plates 17 and 18 along the upper and front edges, whereas the bottom edges of the plates 17 and 18 are not supported. The brackets 30 together with the bottom edge of the plate 4 form a carrying framework 27 connecting the partition walls 16A, whereas the brackets 30 are fastened in a fastening area 19 of the walls 16A extending along the bottom edge of the plate 4.

Figure 5:
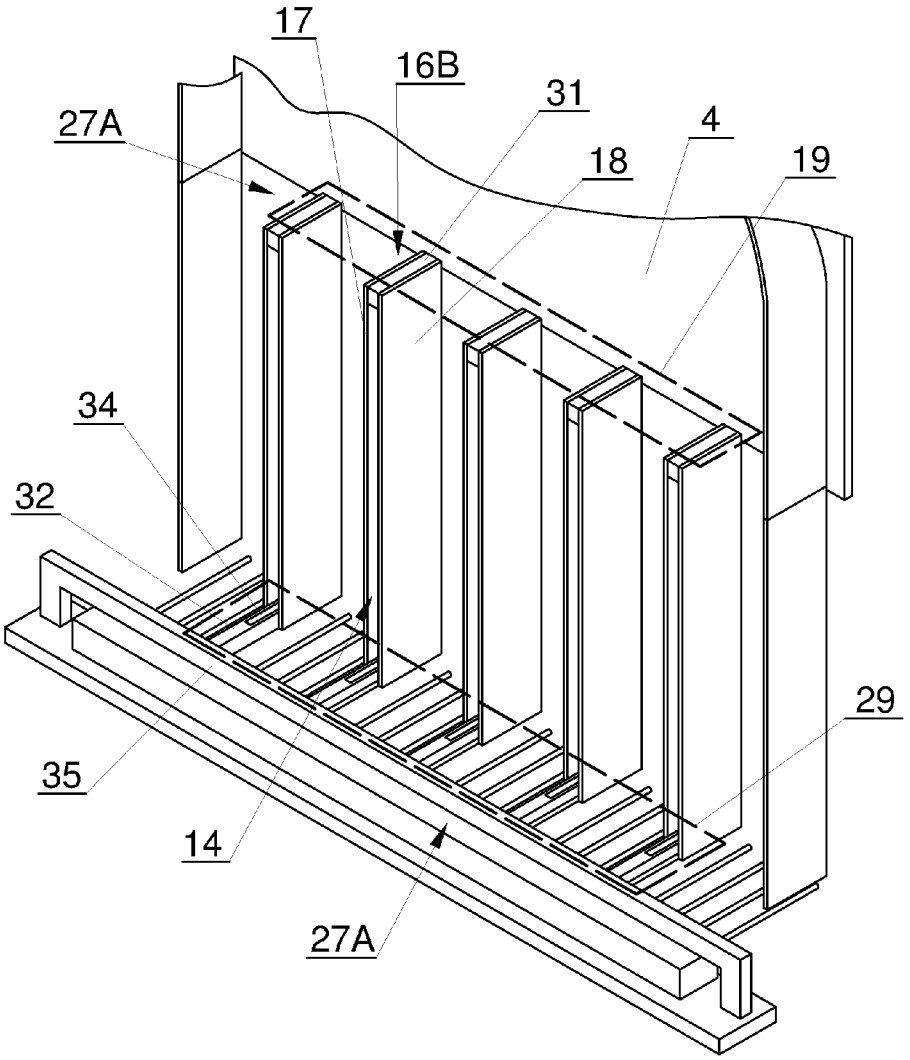
FIG. 5 shows a filling hopper according to the invention in another embodiment.
Figure 6:
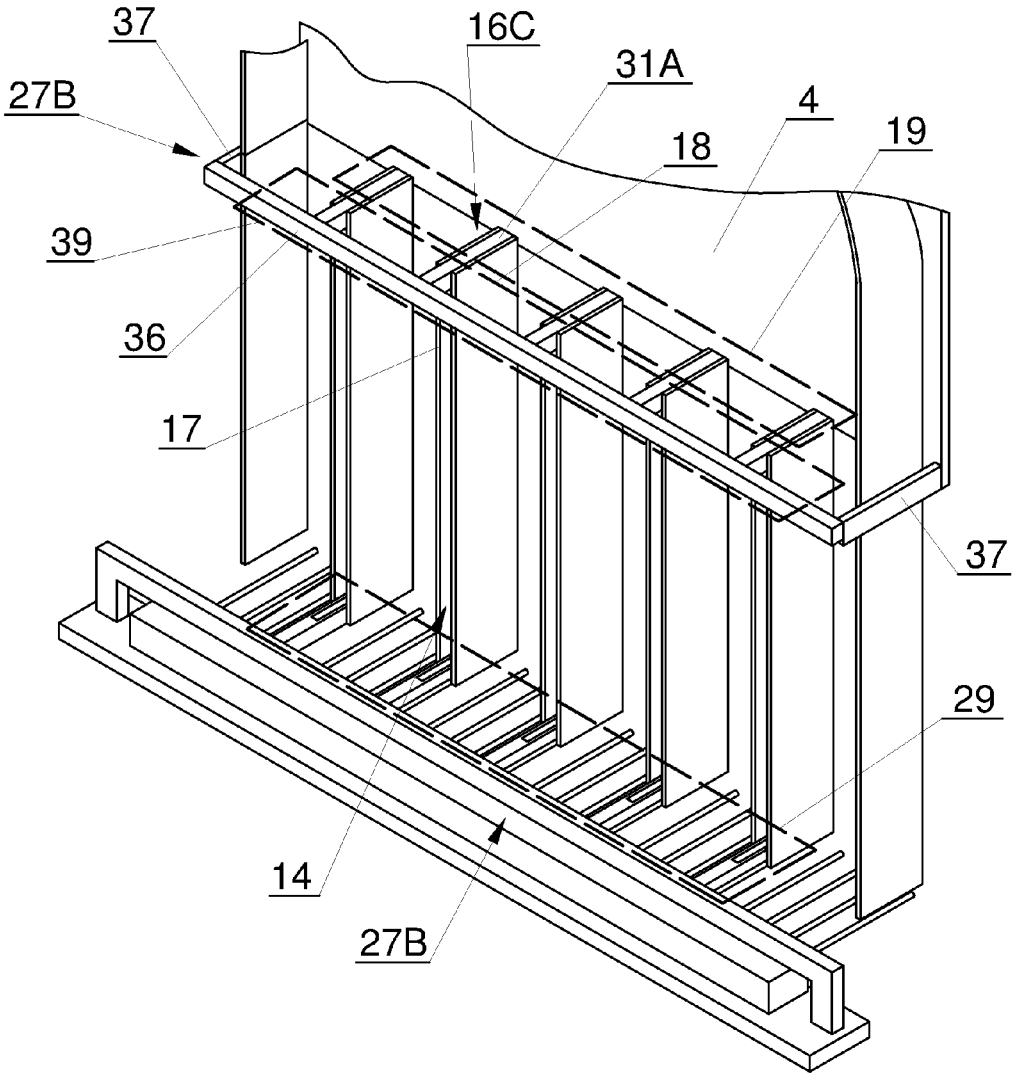
FIG. 6 shows a filling hopper according to the invention in another embodiment being a modification of the embodiment of FIG. 5.
Figure 7:
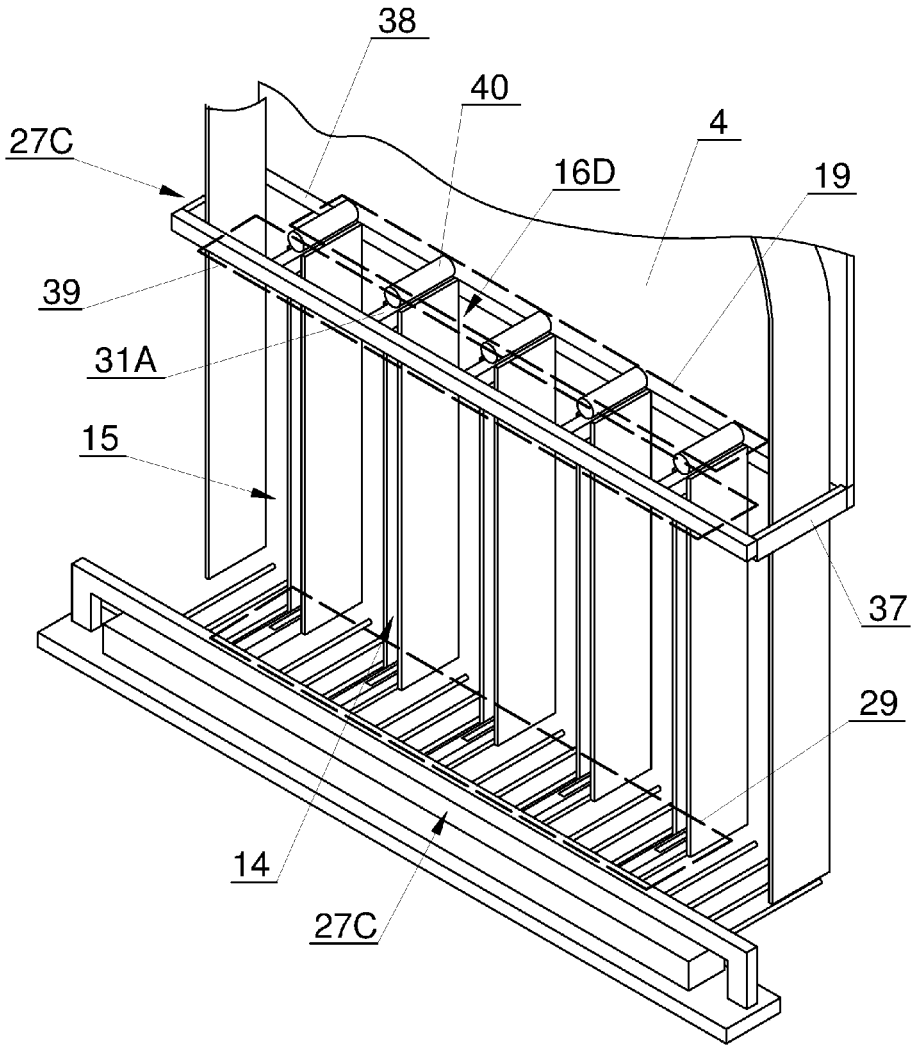
FIG. 7 shows a filling hopper according to the invention in another embodiment.

FIG. 5 shows a filling hopper in which the partition walls 16B are fastened to brackets 31 belonging to the upper part of the carrying framework 27A. The brackets 31 fastened to a plate 4 connect the top ends of the plates 17 and 18 of individual partition walls 16B in the fastening area 19. On the other hand, the bottom ends of the plates 17 and 18 are fastened to brackets 32 belonging to the bottom part of the framework 27A in the fastening area 29 of the walls 16B. In the brackets 32 the sections 34 are formed into which the partition walls 25 of the trays 20 are inserted. The brackets 32 for individual partition walls 16B of the storing region 3 are fastened to a bracket 35, joining the walls 16B, belonging to the bottom part of the framework 27A, disposed on the frame of the machine. The partition walls 25 of the tray 20 after inserting into the slots 14 between the plates 17 and 18 are visible for the operator. The embodiment shown in FIG. 6 is a modification of the embodiment of FIG. 5. The walls 16C are fastened by means of brackets 31A, belonging to the upper part of the framework, longer than the brackets 31, whereas the brackets 31A are joined by means of a beam 36 disposed in the fastening area 39 of the walls 16C, whereas the beam 36 joining individual walls 16C is fastened to the frame of the machine or through the brackets 37 to the plate 4. In this embodiment the plates 17 and 18 of the partition walls 16C are fastened in three fastening areas 19, 29 and 39. In the embodiment shown in FIG. 7 the partition walls 16D are fastened to a beam 38 by means of the brackets 31A and 37 belonging together with the beam 38 to the upper part of the carrying framework 27C, in the fastening area both 19 and 29, whereas the beam 38 is disposed below the plate 4 and fastened to the bottom edge of the plate 4 or to the frame of the machine. The fastening areas 19, 29 and 39 in FIG. 7 run in principle as in FIG. 6, the bottom part of the carrying framework 27C is shaped similar to 27B. Above the partition walls 16D rotary elements 40 supporting the insertion of rod like articles 2 into the cavities 15 are disposed.

Figure 8:
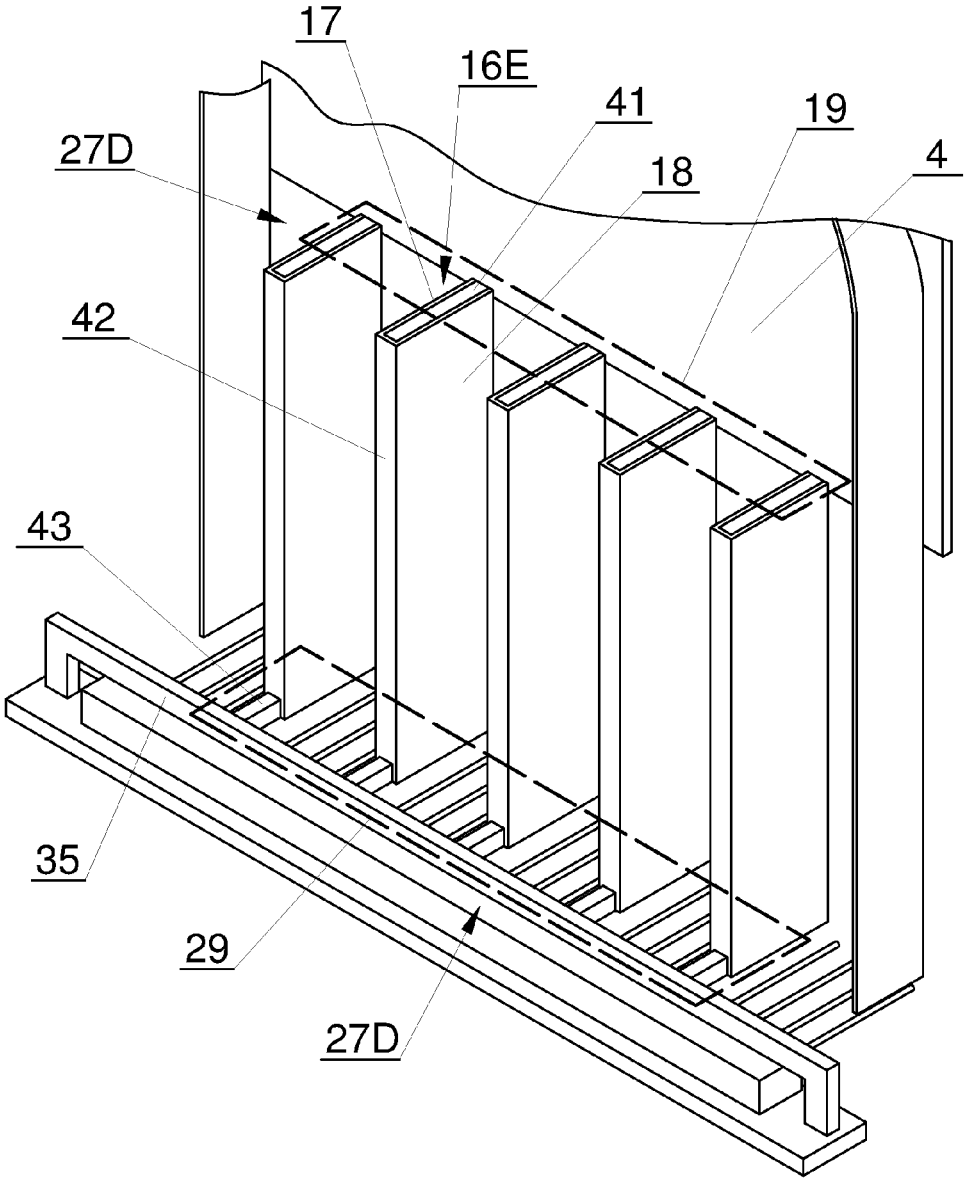
FIG. 8 shows a filling hopper according to the invention in another embodiment.

FIG. 8 shows another embodiment where the top ends of the walls 17 and 18 belonging to the wall 16E are fastened through brackets 41 to the bottom edge of the plate 4, whereas the walls 17 and 18 are connected with each other by means of a front element 42. The bottom ends of the walls 17 and 18 are fastened to a bracket 43 attached to the frame of the machine or the bracket 35. The walls 17 and 18 are fastened to the carrying framework 27D in two fastening areas 19 and 29. The embodiment shown in FIG. 9 is a modification of the embodiment of FIG. 8 where the top ends of the plates 17 and 18 of the walls 16F are joined by means of a roof 44 for the separation of rod like articles 2 before the entry into the cavities 15.

In each of the described embodiments, at the moment of feeding an empty tray 20 for filling, the rod like articles 2 collected in the cavities 15 of the storing area 3 are not limited from behind by any element. If next to the rod like articles 2 collected in the cavities 15 principally parallel to each other incorrectly arranged articles disposed perpendicular to the other articles, in the area below the plate, were situated then before feeding the tray 20 for filling they would fall down, but not into the tray. In the area beneath the storing region 3 a suitable container for falling articles can be provided. When feeding an empty tray for filling, the articles 2 in the cavities 15 do not move, thus in the course of feeding an empty tray 20 to the filling position there is no risk that incorrectly arranged elements fall into the tray. When filling the tray 20 the rear wall 21 of the tray 20 adheres to the articles 2 in the cavities 15 of the storing region 3 and when moving the tray 20 downward in the course of the filling, incorrectly arranged articles, which can appear in the flow of the articles 2 downward in the area uncovered from behind between the plate 4 and the tray 20, will fall not inside but outside the tray.

The carrying framework in terms of this application is not a fragment of the apparatus which can be separated from other units of the apparatus as a compact subassembly. The carrying framework being a space structure can consist for example of two parts or of more parts comprising a plurality of elements attached to the frame of the apparatus. Presented structures of carrying frameworks do not exhaust possible spatial combinations of the partition walls, but are only non-limiting embodiments of a hopper according to the invention. It should be noted, however, that a feature of the carrying framework is the absence of a rear wall.

The partition walls, carrying frameworks and other elements of the receiving and storing region presented above have been shown in a simplified view without structural details and without typical joining elements.

The invention claimed is:

1. A filling hopper for a filling apparatus for multi-segment trays (20) in the tobacco industry with a receiving region (1) for rod like articles (2) in the form of a mass flow (50) and with a storing region (3) for rod like articles (2) comprising side walls (8, 9) and a bottom wall (10), whereas the storing region (3) has double partition walls (16, 16A, 16B, 16C, 16D, 16E, 16F) alternately forming a plurality of parallel cavities (15) and slots (14), where the partition walls (16, 16A, 16B, 16C, 16D, 16E, 16F) extend along the entire height of the storing region (3), wherein the partition walls (16, 16A, 16B, 16C, 16D, 16E, 16F) are connected with each other by means of a carrying framework (27, 27A, 27B, 27C, 27D, 27E) so that from two opposite sides free access to the rod like articles (2) inside the cavities (15) is maintained to allow free falling of incorrectly aligned rod like articles (2).

2. The hopper according to claim 1, wherein the width of the partition walls (16, 16A, 16B, 16C, 16D, 16E, 16F) is smaller than the depth of the storing region (3).

3. The hopper according to claim 1, wherein the carrying framework (27, 27A, 27B, 27C, 27D, 27E) comprises at least one fastening area (19).

4. The hopper according to claim 1, wherein the bottom wall (10) is a filling unit (12).

* * * * *